United States Patent [19]

Busch et al.

[11] 4,246,004

[45] Jan. 20, 1981

[54] METHOD OF MAKING A SEGMENTED CUP GRINDING WHEEL

[76] Inventors: Dieter M. Busch, 35 Hans Strydom Ave., Robindale Ext. 1., Randburg; Christopher G. McAlonan, Artima Farm, District Schoongezicht, Transvaal, both of South Africa

[21] Appl. No.: 601,955

[22] Filed: Aug. 4, 1975

Related U.S. Application Data

[63] Continuation-in-part of Ser. No. 579,576, May 21, 1975, abandoned.

[30] Foreign Application Priority Data

Aug. 15, 1974 [ZA] South Africa ..... 74/5242
Dec. 4, 1974 [ZA] South Africa ..... 74/7723

[51] Int. Cl.[3] ..... B24D 5/06
[52] U.S. Cl. ..... 51/295; 51/206.4; 51/298; 51/309
[58] Field of Search ..... 51/295, 298, 309, 206.4

[56] References Cited

U.S. PATENT DOCUMENTS

| | | | |
|---|---|---|---|
| 1,930,788 | 10/1933 | Buckner | 51/298 |
| 2,545,676 | 3/1951 | Small | 51/309 |
| 3,495,960 | 2/1970 | Schladitz | 51/298 |
| 3,619,152 | 11/1971 | Yalof | 51/298 |
| 3,779,727 | 12/1973 | Siqui | 51/298 |
| 3,829,544 | 8/1974 | Hall | 51/307 |
| 3,868,232 | 2/1975 | Silui | 51/298 |
| 3,918,218 | 11/1975 | Zoiss | 51/298 |
| 3,972,161 | 8/1976 | Zoiss | 51/298 |

*Primary Examiner*—Donald J. Arnold
*Attorney, Agent, or Firm*—Cushman, Darby & Cushman

[57] ABSTRACT

A segment for use in the manufacture of the working portion of an abrasive tool, e.g. a grinding wheel, comprising needle-shaped abrasive particles such as diamond or cubic boron nitride, each having a long axis and a short transverse axis, held in a bonding matrix, a substantial portion of the particles being so aligned that their long axes are substantially normal to the face of the segment which will provide the working face on the tool. The invention further provides a method of making such a segment and a method of making an abrasive tool utilising such segments in which the bonding matrix is only partially set.

3 Claims, 3 Drawing Figures

METHOD OF MAKING A SEGMENTED CUP GRINDING WHEEL

This application is a continuation-in-part of application Ser. No. 579,576 filed May 21, 1975, and now abandoned.

This invention relates to abrasive bodies and more particularly to abrasive bodies for use in abrasive tools such as grinding wheels.

A variety of abrasive tools consisting essentially of an abrasive or working portion bonded to a suitable support are used in industry. The abrasive portion of such tools generally consists of abrasive particles such as diamond, cubic boron nitride, alumina or silicon carbide held in a bonding matrix. The bonding matrix may be resin, vitreous, metal or rubber. Such tools include grinding wheels, saws, drills, cutting tools and so on.

According to this invention, there is provided a segment for use in the manufacture of the working portion of an abrasive tool comprising needle shaped abrasive particles held in a bonding matrix, a substantial portion of the particles being so aligned that their long axes are substantially normal to the face of the segment which will provide the working face in the tool.

The particles may be diamond, cubic boron nitride, aluminium oxide, or silicon carbide particles, but are preferably diamond or cubic boron nitride particles. The term 'needle-shaped particle' as used in this specification and in the claims means an elongate particle having a long axis and a short transverse axis, the ratio of the long axis to the short axis preferably being at least 3:1. In determining the ratio of long axis to short axis one takes the long and short axes of largest dimension. Needle shaped abrasive particles may be selected from a batch of particles using conventional sorting techniques. As regards synthetic particles such as synthetic diamond and cubic boron nitride, certain processes have been proposed which produce a high proportion of needle shaped particles.

The bonding matrix may be any suitable matrix known in the art. Suitable matrices include resins, rubber, vitreous and metal matrices. As regards suitable resins these include phenolformaldehyde, urea-formaldehyde, melamine formaldehyde epoxy, polyimide, alkyd, polyester and polyamide resins. The preferred resin is a phenolformaldehyde resin.

The abrasive particle content of the segment will generally constitute about 10 to 30 volume percent. This content may include not only needle-shaped abrasive particles, but also a certain quantity of abrasive particle which is not of needle-shape. It is preferred that as high a percentage of the abrasive particle content is of needle-shape as possible.

When the matrix is a resin matrix it is preferred that the abrasive particles, particularly if they are diamond or cubic boron nitride, are metal coated. Suitable metals are well known in the art and include nickel, copper, titanium, silver, cobalt, molybdenum, aluminium, manganese, chromium, vanadium, gold, tungsten, iron, zirconium, cadmium, zinc, the platinum group metals and alloys containing one or more of these metals.

The preferred metals are copper and nickel. The metal coating is generally provided in the range of 30 to 80 weight percent, preferably about 50 to 60 weight percent, of the coated particle.

The segments of the invention may be bonded to the support of the abrasive tool using any conventional technique. When the bonding matrix is only partially or incompletely set the segment may be bonded to the support by locating the partially set product on the support and causing complete setting to occur.

The shape of the segment will vary according to the shape of the working portion of the tool of which it is to form part. The segment may be for use in the manufacture of a variety of abrasive tools such as grinding wheels, saws, cutting tools, drills and so on.

Further according to the invention there is provided a method of making a segment as described above including the steps of providing a mixture of needle-shaped abrasive particles and starter ingredients for a bonding matrix, placing the mixture in a segment-defining mould, causing a substantial portion of the particles to so orientate that their long axes are substantially normal to the face of the segment which will provide the working face in the tool, and causing the starter ingredients to set, at least partially, around the particles. The starter ingredients are preferably allowed to set only partially so that final setting can occur during tool manufacture.

The particles may be orientated by means of any suitable impressed field of force. For example, an electrostatic field may be used. It is preferred however, that the impressed field of force is a magnetic field. In this case, the bonding matrix should be non-magnetic and the abrasive particles coated with a suitable magnetic material. For example, the bonding matrix may be a resin matrix and the magnetic coating may be a magnetic metal.

The invention further provides a method of making an abrasive tool having a working portion bonded to a support the working portion comprising abrasive particles held in a bonding matrix, the method including the steps of locating a plurality of segments as described above in which the bonding matrix is only partially set on the support in the form of the working portion and causing the bonding matrix to set completely so bonding adjacent segments to each other and to the support. This method has particular application to the manufacture of grinding wheels such as peripheral or cup grinding wheels. Grinding wheels consist of a hub portion to which is bonded a peripheral grinding or working portion.

The use of segments in the manufacture of the working portions of abrasive tools has the advantage that a uniform distribution of abrasive particle throughout the working portion can be achieved more readily.

By way of example, a method of making a segment for a cup grinding wheel and the manufacture of the grinding wheel using the segment will now be described with reference to the accompanying drawings, in which.

Figure 1:
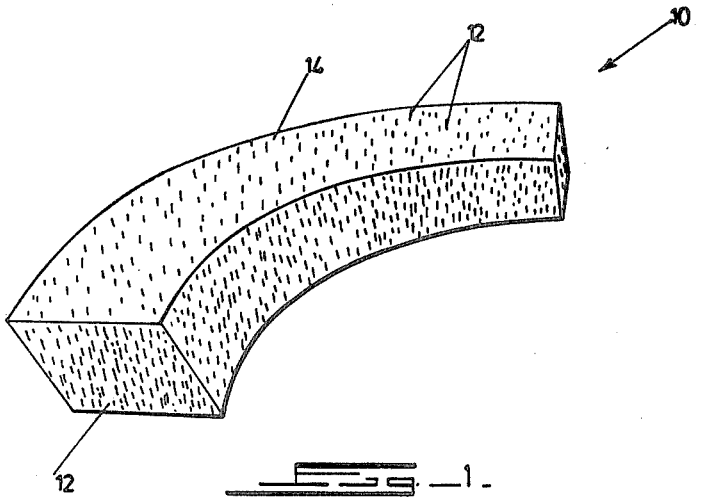
FIG. 1 is a perspective view of a segment for use in a cup grinding wheel.

Referring to FIG. 1, there is shown a segment 10 for a cup grinding wheel. The segment consists of a phenolformaldehyde resin matrix having evenly distributed therein a quantity of nickel-coated needle-shaped diamond particles 12. The face 14 of the segment provides the working face when the segment is part of the working portion of a cup grinding wheel. It is to be noted that the particles are so located in the segment that a substantial portion thereof have their long axes normal to the working face.

Figure 2:
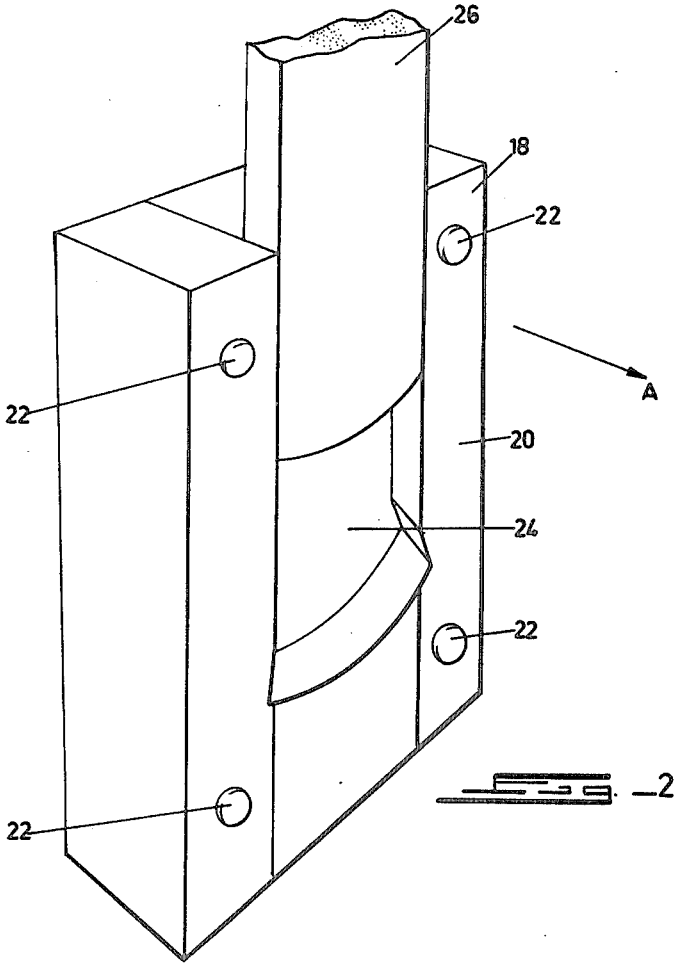
FIG. 2 illustrates schematically a portion of a mould for making the segment.

The segment may be produced using a suitable mould, one half 18 of which is illustrated by FIG. 2. The other half of the mould (which is not illustrated) is simply a block which may be bolted to the face 20 of the first half 18. The half 18 is provided with bolt holes 22 for this purpose. The mould has a cavity 24 for receiving the matrix/abrasive particle mixture. A plunger 26 is used to tamp the mixture into the cavity.

The segment is made by first making a mixture of starter ingredients for the phenolformaldehyde resin and the nickel coated needle-shaped diamond particles. A magnetic field is induced across the mould in the direction of arrow A by means of a suitable magnet. Plunger 26 is removed and the mixture is poured into the mould cavity 24. As the mixture is poured through the magnetic field the nickel coated diamond particles tend to orientate in the direction of arrow A, i.e. they orientate with their long axes in the direction of arrow A. The plunger is then used to tamp and press the mixture into the cavity. If it is desired to set the resin completely then a pressure of about 4 tons/sq. in. is applied to the mixture simultaneously with the application of heating at a temperature of about 175° C. If it is desired to produce a segment in which the resin is incompletely set, then pressure alone is applied to the mixture.

A plurality of segments as produced above may be bonded to the hub of a cup grinding wheel in any conventional manner. If the segments contain incompletely set resin, then no bonding medium need be provided as the segments may be bonded directly to the hub by locating the segments on the hub and applying a pressure of about 4 tons/sq. in. and a heating of the order of 175° C.

Figure 3:
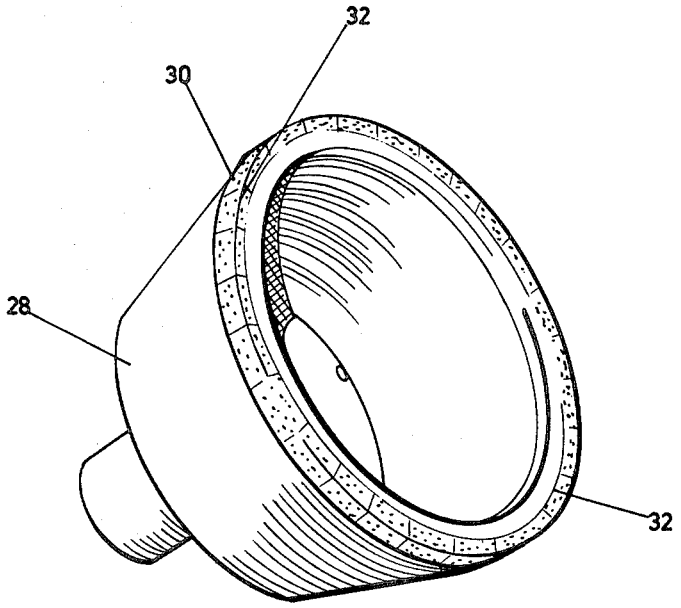
FIG. 3 is a perspective view of a cup grinding wheel utilising a plurality of such segments.

FIG. 3 illustrates a cup grinding wheel manufactured using a plurality of segments. The wheel consists of a hub portion 28 having a peripheral grinding or working portion 30. The peripheral working portion consists of a plurality of segments of the type described above. The working face of the working portion is shown at 32 and is provided by the faces 14 of the segments. Conventionally the working portion of cup grinding wheels are made by locating a mixture of the abrasive particle/-starter ingredients in a recess in the hub portion and then subjecting the mixture to a suitable temperature and pressure to cause the mixture to compact and bond into the working portion. The pressure is applied substantially normal to the face 32. With this prior art method it is difficult to orientate needle shaped particles normal to the working face as the applied pressure will act to destroy any such orientation. On the otherhand, in the segments of the invention, the particles are already firmly supported in a suitably orientated position at the time they are formed into the working portion and the pressure required to bond the segments to the hub portion does not destroy such orientation. Orientation of needle shaped particles substantially improves the grinding efficiency of grinding wheels as illustrated by the comparative results which will now be discussed.

A number of D11V9 flared cup grinding wheels were manufactured in the manner described above using green state segments i.e. segments in which the resin was incompletely set. The wheels had diameters of 100 mm and operative portions of width 3 mm. 10 segments were used in each case to form the operative portion. Each segment had a 50% concentration of needle shaped, nickel-coated diamond particles and the resin was a phenolformaldehyde resin. The wheels were used to dry grind Carboloy 44A (registered trademark), a commercially available tungsten carbide of the General Electric Company, at a traverse speed of 2 M/min., an infeed of 0,05 mm and a spindle speed of 3200 rpm. An average G-ratio of 43 was obtained. A number of wheels of the same type were made using prior art particles and prior art moulding techniques. These wheels also contained nickel coated diamonds in the same concentration and used a phenolformaldehyde bonding matrix. The wheels were tested under the same conditions as the wheels made according to the invention and were found to have an average G-ratio of only 24.

We claim:

1. A method of making an abrasive cup grinding wheel tool having a working portion bonded to a support, the working portion comprising a plurality of segments positioned adjacent one another and bonded to said support, and having abrasive particles held therein in a bonding matrix, the method comprising the steps of mixing a plurality of needle-shaped abrasive particles taken from the group consisting of diamonds and cubic boron nitride, each having a long axis and a short transverse axis wherein the ratio of the long axis to the short axis thereof is at least about 3:1 with a resin bonding matrix, aligning a substantial portion of said particles with their longitudinal axes substantially normal to the face of said segment, partially curing said bonding matrix, positioning a plurality of said segments in said support, and causing the bonding matrix to be completely cured to thereby bond adjacent segments to each other and to the support.

2. A method of making an abrasive cup grinding tool having a working portion bonded to a support, the working portion comprising abrasive particles held in a bonding matrix, the method comprising the steps of making a segment for use in the working portion of the abrasive cup grinding wheel by mixing a plurality of needle-shaped abrasive particles taken from a group consisting of diamonds and cubic boron nitride, each having a long axis and a short transverse axis, wherein the ratio of the long axis to the short axis thereof is at least about 3:1, with a resin bonding matrix; aligning a substantial portion of said particles with their long axes substantially normal to the face of said segment which provides a working surface of said grinding wheel; partially curing the matrix to hold the particles therein; positioning a plurality of said segments in said support; and causing the bonding matrix to be completely cured to thereby bond adjacent segments to one another and to the support.

3. A method of making an abrasive grinding tool having a working portion bonded to a support, the working portion comprising abrasive particles held in a bonding matrix the method comprising the steps of making a segment for use in the working portion of the abrasive grinding wheel by mixing a plurality of needle-shaped abrasive particles taken from a group consisting of diamonds and cubic boron nitride, each having a long axis and a short transverse axis, wherein the ratio of the long axis to the short axis thereof is at least about 3:1, with a resin bonding matrix, aligning a substantial portion of said particles with their long axes substantially normal to the face of said segment which provides a working surface of said grinding wheel and partially curing the matrix to hold the particles therein; positioning a plurality of said segments in said support; and causing the bonding matrix to be completely cured to thereby bond adjacent segments to one another and to the support.

* * * * *